US009055776B1

(12) United States Patent
Martin

(10) Patent No.: US 9,055,776 B1
(45) Date of Patent: Jun. 16, 2015

(54) NECK TIE KNOT ACCESSORY

(71) Applicant: Kim Martin, Edmonds, WA (US)

(72) Inventor: Kim Martin, Edmonds, WA (US)

( * ) Notice: Subject to any disclaimer, the term of this patent is extended or adjusted under 35 U.S.C. 154(b) by 0 days.

(21) Appl. No.: 14/315,444

(22) Filed: Jun. 26, 2014

(51) Int. Cl.
*A41D 27/08* (2006.01)
*A41D 25/06* (2006.01)

(52) U.S. Cl.
CPC ..... *A41D 25/06* (2013.01); *A41D 27/08* (2013.01)

(58) Field of Classification Search
CPC ..... A44C 25/00; A41D 27/08; A41D 25/06
USPC ..... 2/148, 144, 145, 152.1, 153; 24/66.11, 24/66.13, 66.8; 63/20, 33
See application file for complete search history.

(56) References Cited

U.S. PATENT DOCUMENTS 1,635,791 A * 7/1927 Jagemann ..... 24/66.11
2,775,768 A * 1/1957 Stern ..... 2/151
3,218,650 A * 11/1965 Less ..... 2/154
3,588,918 A * 6/1971 Thistle ..... 2/153
4,059,853 A * 11/1977 Girdler ..... 24/66.4
5,134,861 A * 8/1992 Koven ..... 63/33
5,313,810 A * 5/1994 Koven ..... 63/33
6,904,613 B2 * 6/2005 Dotterer ..... 2/156
7,162,747 B2 * 1/2007 Sampy ..... 2/152.1

FOREIGN PATENT DOCUMENTS

JP 08131224 * 5/1996
KR 101124980 * 3/2012

* cited by examiner

*Primary Examiner* — Anna Kinsaul
(74) *Attorney, Agent, or Firm* — Dean A. Craine

(57) ABSTRACT

An accessory for supporting the Windsor knot on a tie worn around the neck comprising a thin, narrow rigid or semi-rigid support member configured to slide vertically in between the wrapped layers of a Windsor knot. In one embodiment, the accessory includes a forward, upward extending hook designed to extend over the top edge of the Windsor knot when the support member is inserted into the Windsor knot. Formed or attached to the front edge of the hook is a decorative element. The support member is may be longer than the width of the Windsor knot so the lower end of the support member is visible. A decorative element may be attached or imprinted on the lower end. In a second embodiment, the upper hook is rotated rearward and a forward, upper extending lower hook is attached or formed on the support body. A decorative element is attached to the front surface of the lower hook.

4 Claims, 5 Drawing Sheets

NECK TIE KNOT ACCESSORY

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to men's necktie accessories, and more particularly to ties accessories used on a Windsor knot.

2. Description of the Related Art

Windsor knots are commonly formed on neckties worn with spread collar shirts. The knot is formed by wrapping the wide end of the tie material around the narrow end of the tie material, extending the wide end through a loop formed between the knot and the neck and then extending the wide end through a front, horizontally aligned loop. The two ends of the tie material are then pulled downward forcing the knot upward into the collar space between the two collars and against the user's neck.

Ideally, the knot should be sufficiently drawn upward into the collar space to hide the top button and the upper edge of the shirt. Also, the knot should be correctly formed so the top edges of the loops are straight and evenly overlap. Unfortunately, some men are not skilled at tying Windsor knots in neckties and some men prefer to wear a necktie with the top button of the shirt detached thereby cause the knot to partially droop. Some men prefer to wear neckties that are unique or more fashionable than neckties worn by other men.

What is needed is a necktie accessory that covers up Windsor knots that are improperly formed. What is also needed is a necktie accessory that partially covers the top edge of the Windsor knot and the shirt's top button. What is also needed is a necktie accessory that is used as an ornamental fashion accessory.

SUMMARY OF THE INVENTION

An accessory for supporting the Windsor knot on a necktie worn around the neck comprising a flat, narrow, longitudinal support member and an upper hook formed on one end. The support member is made of thin planar structure or made of one or more thin strips of rigid or semi-rigid material configured to slide over the wide end of a tie and fit into the front loop formed on the Windsor knot. In one embodiment, the upper hook extends upward and bends downward over the top edge to the front loop holding the accessory in place. A decorative element may be attached or imprinted on the front surface of the upper hook. Also, the support member is slightly longer than the width of the Windsor knot so the lower edge of the support member extends below the lower edge of the Windsor knot. A second decorative element compatible with the decorative element on the front surface of the upper hook may be attached or imprinted on to the front surface of the lower exposed portion of the support member.

In a second embodiment, the upper hook is rotated on the support member so it extends upward and rearward and then bends downward behind the Windsor knot and hidden from view when worn. The lower end of the support member includes a lower hook that extends downward and forward and then bends upward over the lower front surface of the Windsor tie. Attached or imprinted onto the front surface of the lower hook is a decorative element.

In third embodiment, the accessory includes a forward, downward extending upper hook and a forward, upward extending lower hook with a decorative element attached to the front surface of the lower hook and an optional decorative element attached to the front surface of the upper hook.

DESCRIPTION OF THE PREFERRED EMBODIMENT(S)

Figure 1:
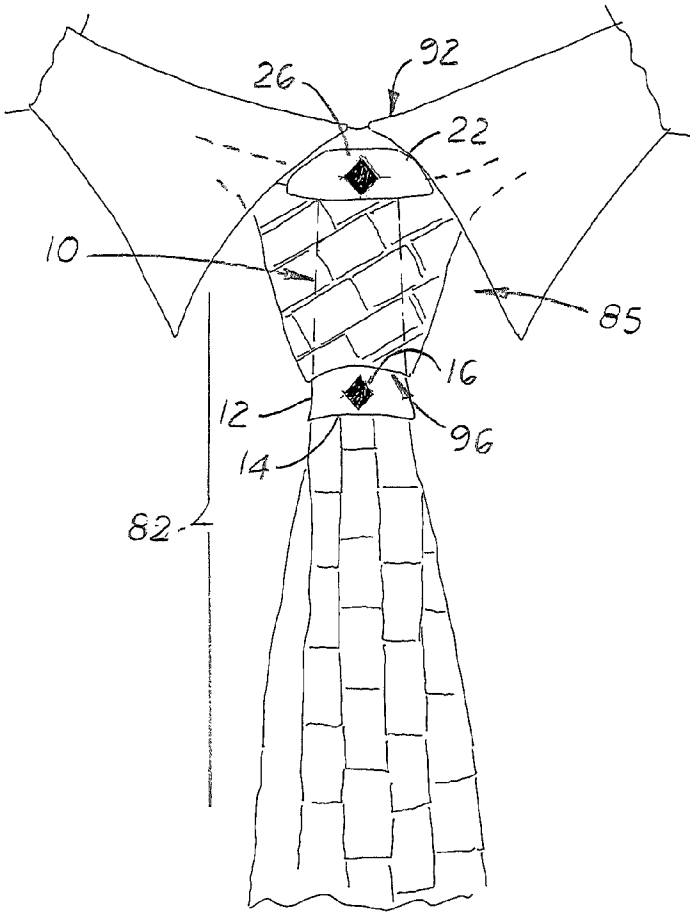
FIG. 1 is an illustration of a collar dress shirt with a necktie with a Windsor knot and showing the first embodiment of the neck tie accessory installed.

FIG. 1 shows a necktie accessory 10 for supporting the Windsor knot 85 on a necktie 82 worn around the collar 92 of dress shirt that supports the knot 85 and partially holds it upright and tight, and allows the knot 85 to be worn loosely around the collar 92 for greater comfort while also enhances the knot's appearance.

Figure 2:
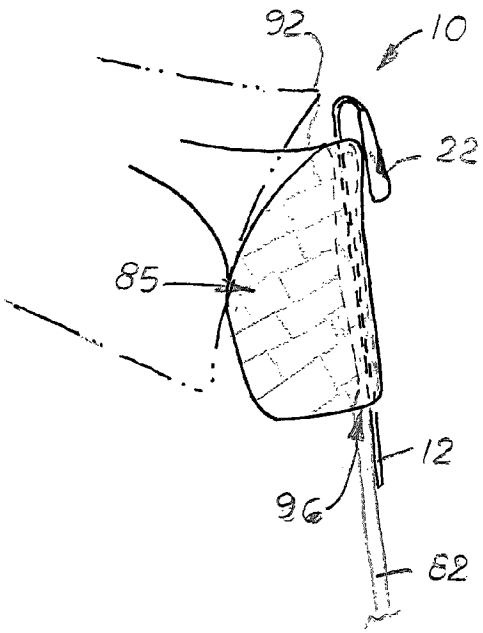
FIG. 2 is a partial side elevational view of the Windsor knot tied in a necktie placed around the collar of a wearer with the first embodiment of the necktie accessory mounted thereon.
Figure 3:
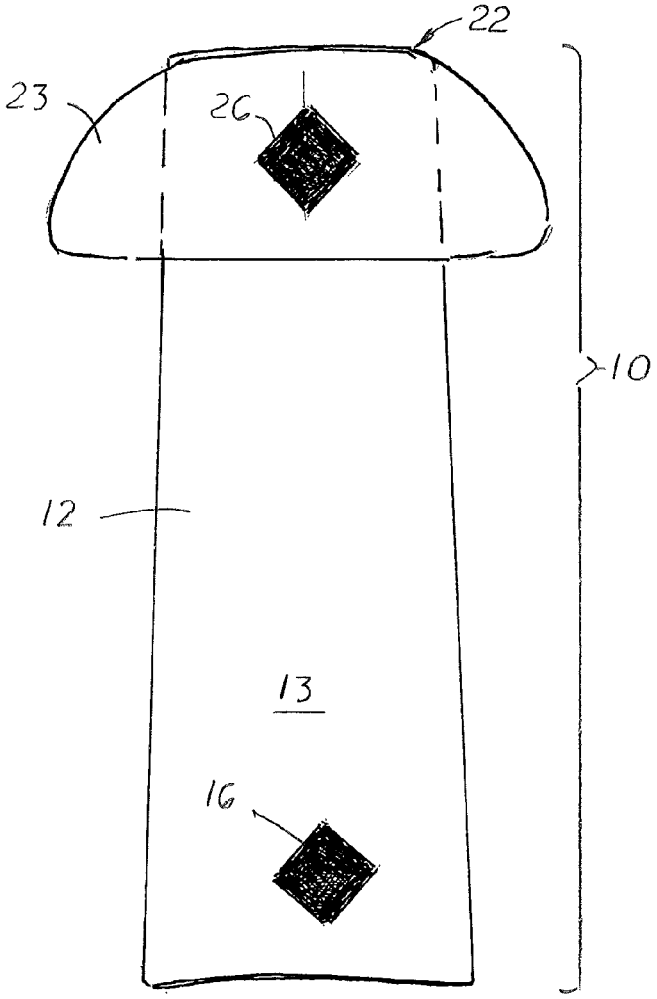
FIG. 3 is a front elevational view of the first embodiment of the necktie accessory.
Figure 4:
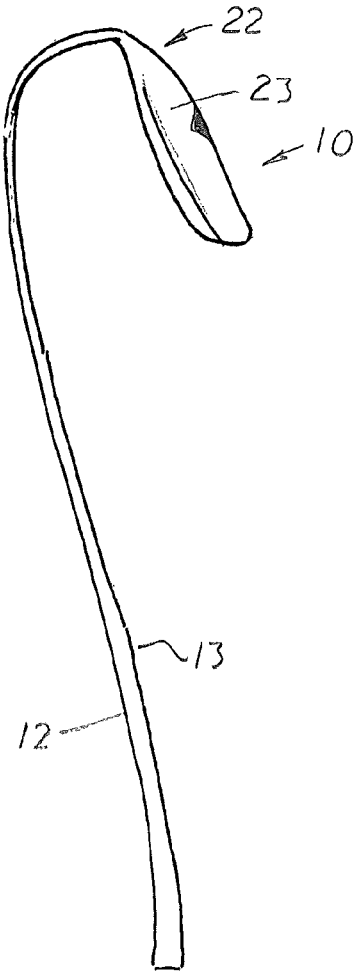
FIG. 4 is a side elevational view of the necktie accessory shown in FIGS. 1-3.
Figure 5:
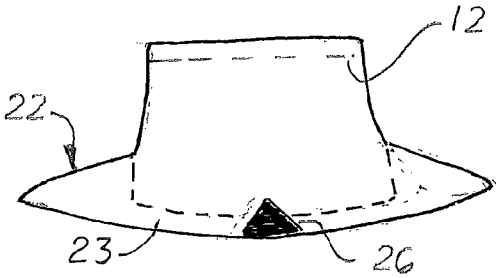
FIG. 5 is a top plan view of the necktie accessory shown in FIGS. 1-4.

As shown in FIGS. 3-5, the accessory 10 comprises a flat, support member 12 and an upper forward upper hook 22. The support member 12 is made of rigid or semi-rigid material configured to slide over the wide end of a necktie 82 and fit into the front loop 86 formed on the Windsor knot 85 (see FIGS. 1 and 2). The upper hook 22 extends upward and forward and then bends over the top edge to the front loop 86 holding the accessory 10 in place on the Windsor knot 85. As also shown in FIGS. 1 and 2, the support member 12 is slightly longer than the width of a Windsor knot 85 (i.e. the width is the vertical dimension of a Windsor knot 85 when tied tightly around the neck) so the lower edge 14 of the support member 12 extends below the Windsor knot 85 and is visible when the necktie 82 is worn around the wearer's color 92 as shown in FIGS. 1 and 2. Both the front surfaces 13, 23 of the support member 12 and the extended tab 22, respectively may include decorative indicia or elements 16, 26, respectively, that enhance their appearances, (see FIGS. 3-5).

Figure 6:
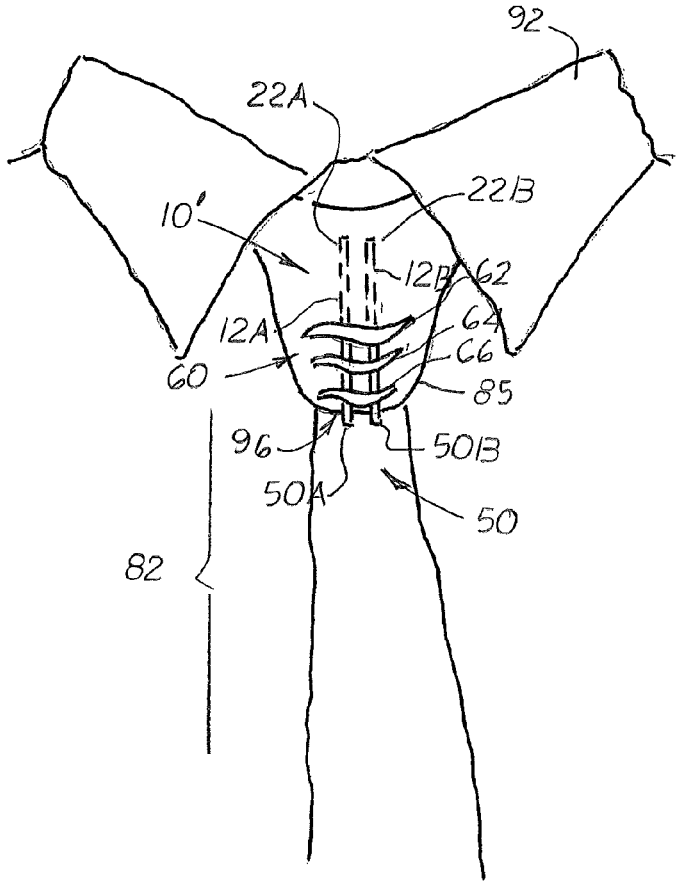
FIG. 6 is an illustration of a collar dress shirt with a necktie with a Windsor knot and showing the second embodiment of the necktie accessory installed with three fish tail decorative elements attached to the front surface of the lower hook.
Figure 7:
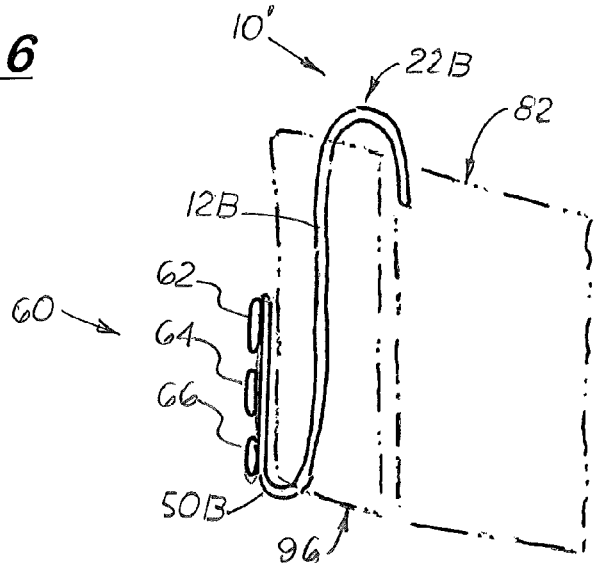
FIG. 7 is a partial side elevational view of the Windsor knot tied around the collar with the second embodiment of the necktie accessory shown in FIG. 6.

FIGS. 6-9 show a second embodiment of the accessory 10' showing the upper hook 22 rotated on the support member so it extends upward and rearward and then bends downward behind the Windsor knot 85 and hidden from view when the necktie 82 is worn. The lower end of the support member includes a lower hook that extends forward and upward through the lower opening 96 formed on near the front surface of the Windsor knot 85. Attached or imprinted onto the front surface of the lower hook is a decorative element 60. In FIGS. 6 and 7, the support member 12 is shown as two parallel bars 12A, 12B with a lower hook 50A, 50B, respectively, attached or formed on their lower ends and with upper hook elements 22A, 22B, respectively attached or formed on their upper ends. The lower hooks 50A, 50B each include an outer leg. Attached to the front surfaces of the two outer legs is a decorative element 60. In FIGS. 6 and 7, the decorative element 60 is shown as three fish tail decorative elements 62, 64, and 66 aligned transversely with and attached to the front surface of the outer legs on the two lower hooks 50A, 50B.

Figure 8:
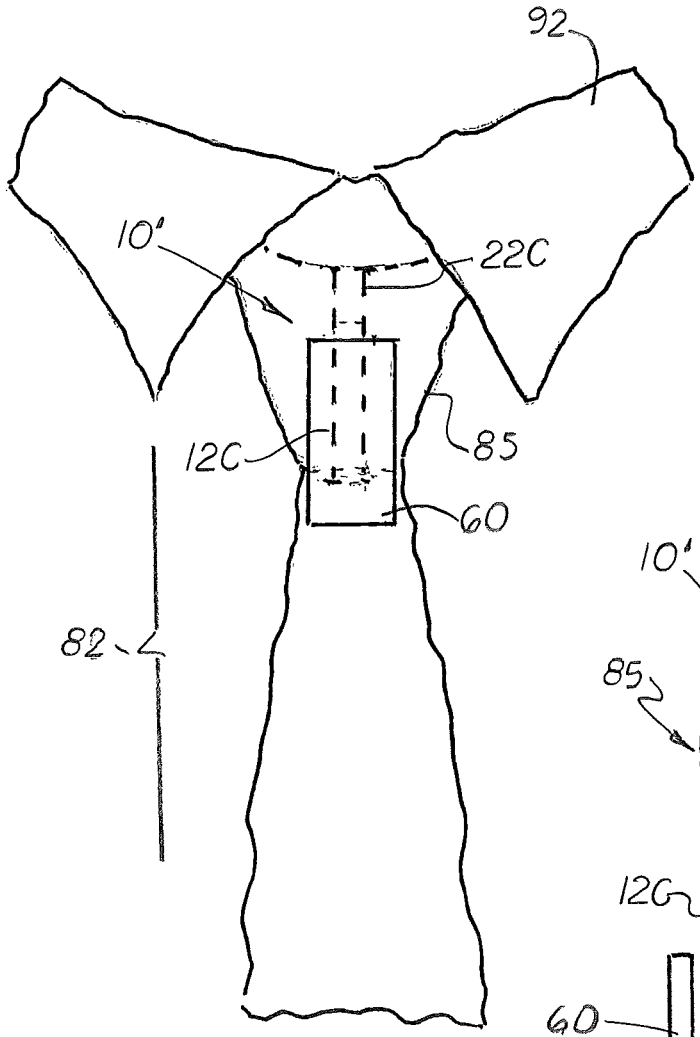
FIG. 8 is an illustration of a collar dress shirt with a necktie with a Windsor knot and showing the second embodiment of the neck tie accessory installed with a single planar decorative element attached to the front surface of the lower hook.
Figure 9:
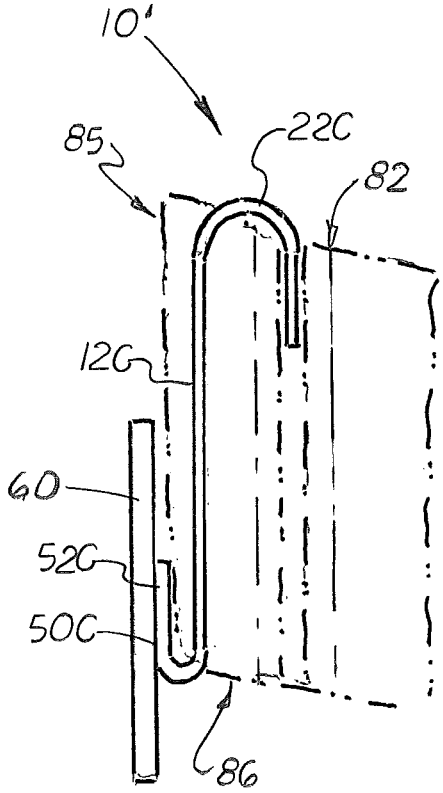
FIG. 9 is a partial side elevational view of the Windsor knot tied around the collar with the second embodiment of the neck tie accessory shown in FIG. 8.

FIGS. 8 and 9 are illustrations of a collar dress shirt with a tie with a Windsor knot 85 and showing the second embodiment of the necktie accessory 10' with the support member comprises a single bar structure 12C with an rearward and downward extending upper hook 22C formed on one end and a forward and upward extending lower look 50C formed on the opposite end. During installation, the single bar structure 12C is inserted in between the two front layers of the knot 85 and the upper hook 22C is extended rearward and bends around an adjacent knot layer. The lower hook 50C extends upward and bends over the lower front edge of the knot 85. A single planar decorative element 60 is attached to the front surface of the outer leg 52C of the lower hook 50C and designed to cover at least the lower half of the knot 85 when installed.

The accessories shown in FIGS. 6-9 both include a rearward, and downward extending upper hook a forward, upward extending lower hook and a decorative element attached or formed on the lower look.

Figure 10:
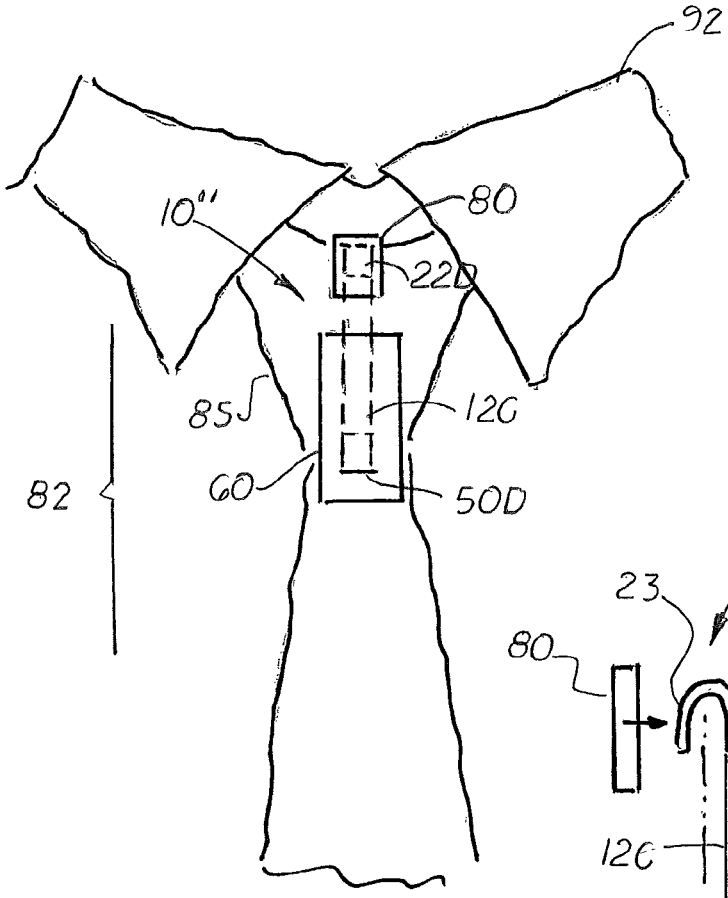
FIG. 10 is an illustration of a collar dress shirt with a necktie with a Windsor knot and showing the third embodiment of the necktie accessory installed with a forward, downward extending upper hook and a forward, upward extending lower hook with a decorative element attached to the front surface of the lower hook and an optional decorative element attached to the front surface of the upper hook.
Figure 11:
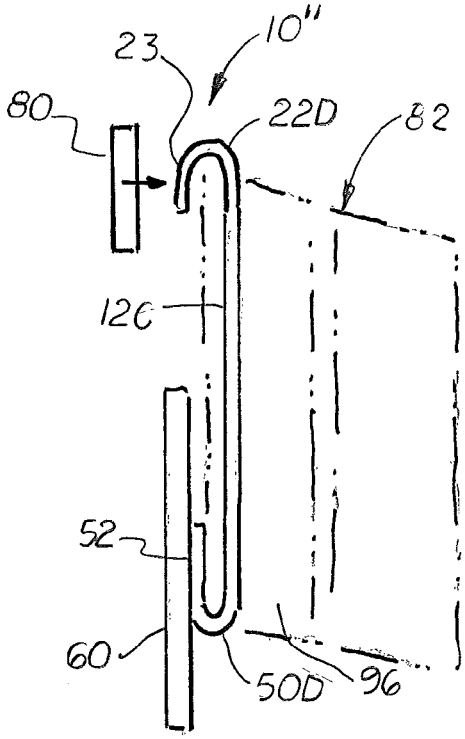
FIG. 11 is a partial side elevational view of the Windsor knot tied around the collar with the third embodiment of the necktie accessory shown in FIG. 10.

FIGS. 10 and 11 are illustrations of a collar dress shirt with a necktie 82 with a Windsor knot 85 and showing a third embodiment of the neck tie accessory 10" installed with an upward, forward, downward extending upper hook 22D, a downward, forward, extending lower hook 50D that bends over the lower edge of the knot 85 with a decorative element 60 attached to the front surface 52 of the lower hook 50D and an optional decorative element 80 attached to the front surface of the outer leg on the upper hook 22D. It should also be understood that other types of decorative elements may be attached to the upper hook 22D and to the lower hook 50D In the embodiments shown herein, the support member 12 is 1 to 2 inches in length and ¼ to ¾ inches in width. The upper hooks 22, 22A, 22B, 22C and 22D measure approximately ⅛ to ½ inches in length. On the second embodiment shown in FIGS. 6 and 7, the lower hooks 50A, 50B each measure approximately ¼ to 1 inch in length and ½ to 2 inches in width (i.e. side to side measurement). The measurement between the center axes of the upper hooks 22A, 22B and the lower hooks 50A, 50B on accessory 10' is approximately 1 to 2 inches. In the second embodiment, the fish tails 62, 64, 66 measure approximately ½ to 1 inch in length and the bars 12A and 12B are approximately 1½ to 3 inches in length and spaced apart ¼ to ½ inches.

The embodiments shown in FIGS. 8-11, the decorative element 60 is approximately ½ to 1¼ inches in width and ½ to 2 inches in length. In the third embodiment shown in FIGS. 10 and 11, the support member 12C also measures 1 to 2 inches in length and ¼ to ¾ inches in width.

It should be understood that lengths, widths and shapes of the support members, the upper hooks, lower hooks and decorative elements are not limited to the above stated measures may vary.

As disclosed herein is a necktie 82 with an improved Windsor knot 85 presented thereon, comprising;

a. a necktie 82 made of cloth tied into a Windsor knot 85 around a wearers' collar 92, said Windsor knot 85 includes a plurality of layer 86, 87 wrapped tightly together; and, b. an accessory 10 that includes support member 12 configured to slide vertically in between said layers 86, 87 of cloth used to form a Windsor knot 85, and a upper hook 22 attached or formed on said support member 12 that extends over an adjacent layer 86 or 87 of cloth to hold said support member 12 is positioned on the Windsor knot 85, and a decorative element 16, 26, 70 or 80 attached to said support member 12 and visible over the front surface of a Windsor knot 85 when said support member 12 is inserted into said Windsor knot 85.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. An accessory for supporting a knot formed in a tie made up of multiple wrapped layers of tie material and positioned around a collar of a shirt to be worn by a wearer, the accessory comprising:

a. a rigid or semi-rigid thin support member comprising two parallel bars configured to slide vertically in between said wrapped layers of said knot, each said bar having a first end and a second end;

b. an upper hook attached or formed on said first end of each said bar, said upper hook extending away and downward from said bar and configured to bend over a portion of said tie material when said bars are positioned in between said wrapped layers;

c. a lower hook attached or formed on said second end of each said bar opposite said upper hook, said lower hook comprising an outer leg that bends forward and upward from said bar and partially covers said knot when said support member is positioned in between said wrapped layers of said tie material forming knot, said outer leg includes a front surface, and;

d. a decorative element attached, formed or imprinted on said outer leg of said lower hook, said decorative element being visible when said support member is inserted in between said wrapped layers of said tie material to form said knot positioned around said shirt collar of said wearer.

2. The accessory as recited in claim 1, wherein said decorative element comprises at least one transverse member attached to said two parallel bars.

3. The accessory as recited in claim 1, wherein said decorative element comprises a rigid planar structure attached to said outer leg on said lower hook.

4. An improved knot, comprising:

a. a necktie made of cloth tied into a knot to be positioned around a wearer's neck, said knot includes a plurality of layers of tie material wrapped tightly together;

b. a rigid or semi-rigid thin support member comprising a single bar or two parallel bars, each bar having a first end and a second end configured to slide vertically in between said wrapped layers of said knot;

c. an upper hook extending rearward or forward and downward from each said bar, said upper hook further attached or formed on the first end of each said bar, said upper hook configured to be adjacent to and to bend over a portion of said tie material when said support member is positioned in between said wrapped layers;

d. a lower hook attached or formed on said support member opposite said upper hook, said lower hook includes an outer leg that bends forward and upward from each said bar and partially covers said knot when said support member is positioned in between said wrapped layers of said tie material forming said knot, said outer leg includes a front surface, and;

e. a decorative element attached, formed or imprinted on said outer leg of said lower hook, said decorative element being visible when said support member is inserted in between said wrapped layers of said tie material to form said knot positioned around said wearer's neck.

* * * * *

UNITED STATES PATENT AND TRADEMARK OFFICE

CERTIFICATE OF CORRECTION

PATENT NO. : 9,055,776 B1
APPLICATION NO. : 14/315444
DATED : June 16, 2015
INVENTOR(S) : Kim Martian It is certified that error appears in the above-identified patent and that said Letters Patent is hereby corrected as shown below:

ON THE TITLE PAGE

Page 1 - Item (12) should read "MARTIAN"

Page 1 - Items (71) and (72). Please correct Applicant and Inventor's name to KIM MARTIAN.

Signed and Sealed this
Thirteenth Day of October, 2015

Michelle K. Lee

Michelle K. Lee
*Director of the United States Patent and Trademark Office*